United States Patent [19]

Schramm et al.

[11] 4,003,422

[45] Jan. 18, 1977

[54] PROCESS FOR MAKING A COMPOSITE CYLINDER HEAD ASSEMBLY

[76] Inventors: Buford J. Schramm, 1330 E. Fremont Drive, Tempe, Ariz. 85281; Robert G. Everts, 2118 E. Birchwood Ave., Mesa, Ariz. 85204

[22] Filed: Apr. 21, 1975

[21] Appl. No.: 570,032

[52] U.S. Cl. ..... 164/9; 164/98; 164/112

[51] Int. Cl.[2] ..... B22C 9/10; B22D 19/08

[58] Field of Search ..... 164/98, 111, 112, 332, 164/369, DIG. 2, 9–11

[56] References Cited

UNITED STATES PATENTS 3,173,451 3/1965 Slayter ..... 164/98 UX

*Primary Examiner*—Robert D. Baldwin

*Attorney, Agent, or Firm*—Donald D. Mon

[57] ABSTRACT

A cast composite cylinder head assembly for an internal combustion engine having a cylinder liner cast integrally with a cylinder head, and a process for making the same wherein, as the consequence of a casting process, open continuous passages can be formed inside the cylinder head itself, in a bore in the liner, and in ports through the liner.

1 Claim, 11 Drawing Figures

PROCESS FOR MAKING A COMPOSITE CYLINDER HEAD ASSEMBLY

This invention relates to internal engine cylinder heads having an internal liner.

Shortcomings in the casting art have prevented the optimum production of low cost cylinder heads that include liners. Low cost composite heads are needed for inexpensive internal combustion engines such as the low cost two-cycle, single stroke engine used for chain saws. The optimum construction would be a composite unitary construction of a strong, wear-resistant steel liner to form a cylinder within which the piston reciprocates, and a surrounding inexpensive cast metal cylinder head which can be formed with fins for cooling, all with a minimum of machining operations. While it has been proposed to insert cylinder liners in cylinder heads, the prior art does not provide means for also casting the necessary passages for gas flow, nor for placing the cylinder liner reliably in position during the casting operation, all with minimum machinery, equipment and expense.

It is an object of this invention to provide a casting process and a resulting cast composite product wherein a cylinder liner may be cast integrally with a surrounding cylinder head, and the necessary passages to and through the cylinder liner may be formed inexpensively and as a part of the casting process without requiring subsequent machining for their formation.

A cylinder head assembly according to this invention includes a liner having a circularly cylindrical bore for accommodating a piston. The bore has a central axis. The liner has a plurality of ports passing therethrough for gas flow, and an integral cylinder head is cast contiguously upon the outer wall of the liner, at least two passages being formed in the head, which passages are bounded by a portion of the said outer wall. A plurality of fins are formed integrally as part of said cylinder head.

This invention also contemplates the use of an intermediate structure to form the above composite cylinder head assembly, the intermediate structure comprising the said sleeve having a plurality of ports extending therethrough, having its inside bore and ports filled with a reducible material resistant to molten casting metal, and with said reducible material extending axially along and forming a bulge upon the outer wall of the sleeve liner, said intermediate structure being adapted to be cast into cast metal, and the reducible material thereafter being removed to leave the liner and its ports open and unimpeded and to form passages extending along the outer wall of the liner partially bounded by the said outer wall.

The above and other features of this invention will be fully understood from the following detailed description and the accompanying drawings, in which.

Figure 1:
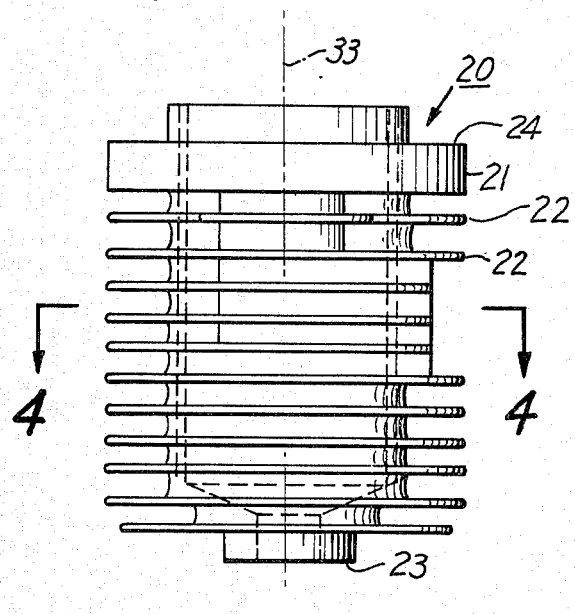
FIG. 1 is a side view of the presently preferred embodiment of the invention.
Figure 2:
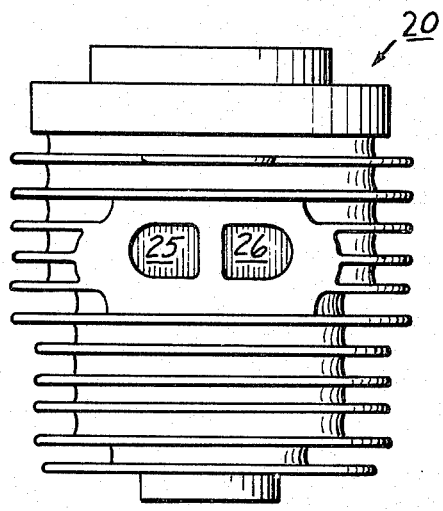
FIG. 2 is a right-hand view of FIG. 1.
Figure 5:
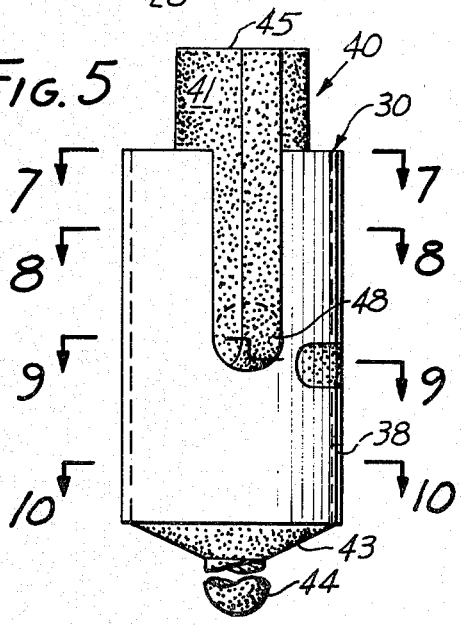
FIG. 5 is a side elevation of an intermediate structure according to the invention.
Figure 6:
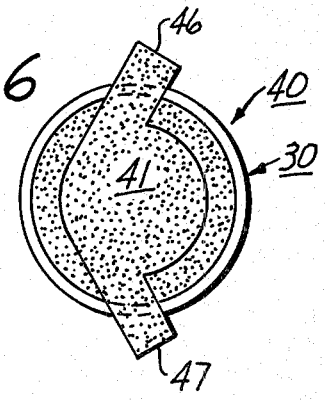
FIG. 6 is a top view of FIG. 5.
Figure 7:
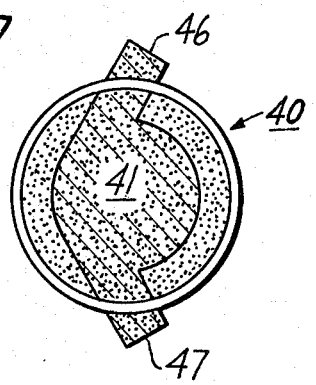
Figure 8:
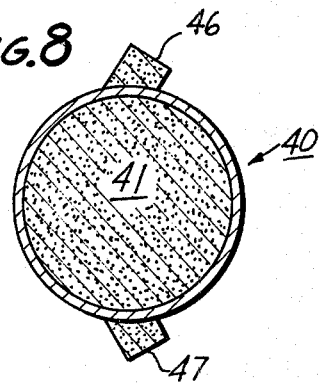
Figure 9:
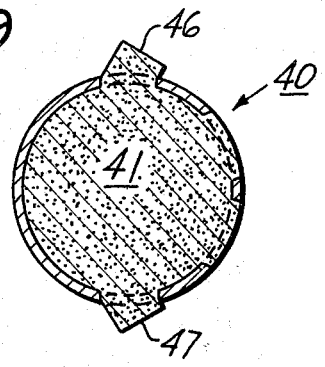
Figure 10:
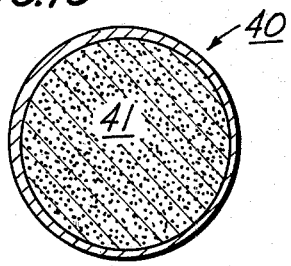
Figure 11:
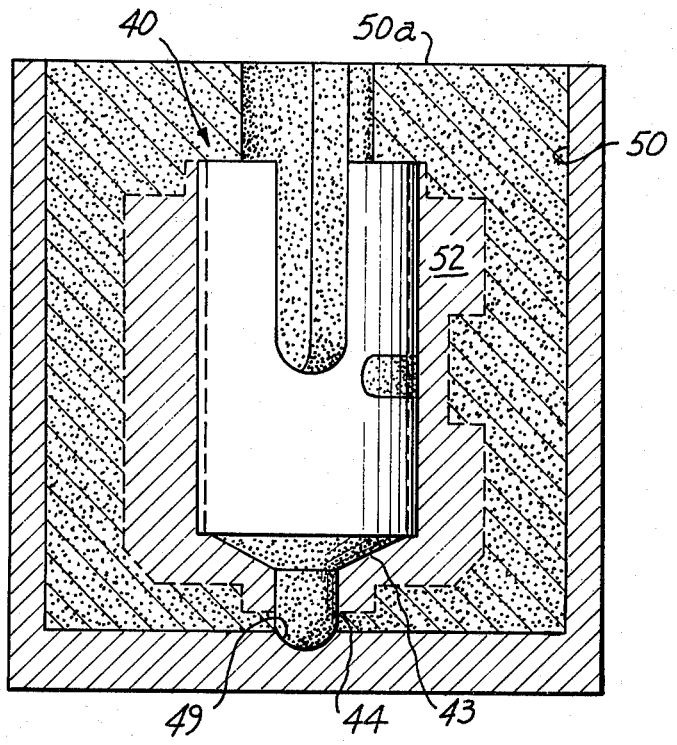

FIGS. 7, 8, 9 and 10 are cross-sections taken at line 7—7, 8—8, 9—9 and 10—10, respectively, in FIG. 5; and FIG. 11 shows the intermediate structure in the process of being cast inside a surrounding body to form the composite cylinder head assembly of FIG. 1.

FIG. 1 shows a composite cylinder head assembly 20 according to the invention. The assembly comprises a cylinder head 21, which is a fully peripheral body having cooling fins 22 and end bosses 23, 24, which bosses may be machined smooth after the casting process, if desired, and a cylinder liner 30.

Figure 3:
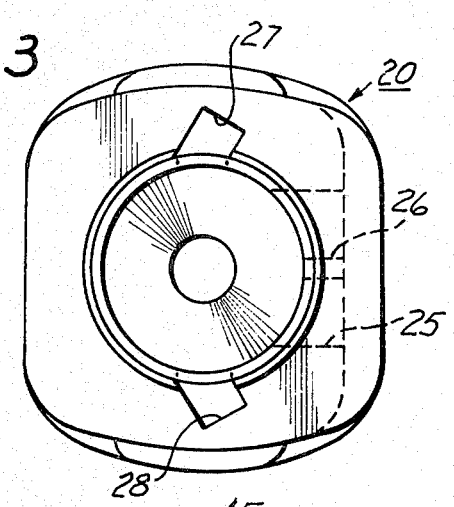
FIG. 3 is a top view of FIG. 1.
Figure 4:
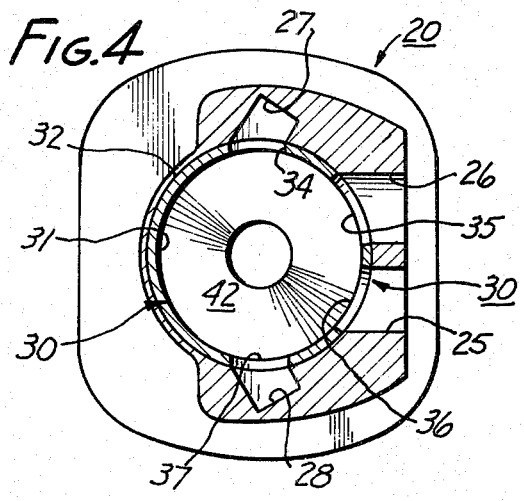
FIG. 4 is a cross-section taken at line 4—4 of FIG. 1.

A pair of passages 25, 26 pass through the cylinder head and connect with ports yet to be described. Axial passages 27, 28 (see FIGS. 3 and 4) pass axially inside the cylinder head and terminate at boss 24. Passages 27 and 28 are partially bounded by the metal of the cylinder head and partially by the outer wall of cylinder liner 30 which forms a portion of the assembly 20.

Liner 30 is a tubular sleeve having an inner wall 31 and an outer wall 32. It is a right circular cylinder having a longitudinal axis 33. Four ports 34, 35, 36, 37 are formed through the liner extending between walls 31 and 32. Ports 34 and 37 communicate with passages 27 and 28, and ports 35 and 36 communicate with passages 25 and 26.

Persons familiar with the operation of two-cycle engines will recognize passages 27 and 28 as being for conducting fuel/air mixture to the cylinder and the other two ports as being for conducting exhaust gases from the bore.

A hole 38 through the wall of the cylinder liner provides a means to align the sleeve in a mold during the formation of an intermediate structure which next will be described.

The expedient and inexpensive casting of the product which is relatively inexpensive to manufacture requires the use of an intermediate structure 40, as best shown in FIGS. 5–10. This structure includes the cylinder liner 30 itself and a removable core 41 of reducible material formed as a self-shape-retentive body which is resistant to casting temperatures. A typical example is foundry casting sand which can be compressed to the shape shown in an intermediate mold (not shown) around the liner, with or without a binder, so it remains as an integral piece. It will be noted that the reducible material fills the inside bore 42 of the liner and extends through all of the ports in the liner. It also includes a nose 43 with a locator pin 44 thereon, together with a riser 45 and a pair of fins 46, 47. The fins extend axially along the riser and then along the outer wall of the liner, contiguous thereto, to ports 34 and 37. The ends at these ports, such as end 48, are curved so as to shape the boundary of a gas flow passage, as will later be understood. Hole 38 locates the sleeve ports relative to the intermediate mold so the fins are formed in the correct places.

The removable core is continuous and integral and keys itself to the sleeve. After it is formed, it is placed in mold box **50*a* with the locator pin 44 resting in a recess 49 to position the intermediate structure. Similarly, other positioning means can be placed against the riser to support the cylinder liner precisely where desired. The hemispherical shapes of locator pin 44 and of the recess 49 cooperate to locate the intermediate structure in the mold. The cylindrical locator pin forms a central hole in the completed cylinder head assembly. The fins are asymmetrical (see FIG. 6**) so the intermediate structure can readily be oriented in the mold.

The intermediate structure is placed inside a casting mold 50, which may be a separable permanent mold or a sand casting mold, as desired, and molten casting metal 52, while molten, is shot into the space between them. Suitable risers (not shown) are formed in accordance with standard casting practice.

The removable core 41 excludes metal from the regions which it occupies. The mold box is shown in purely schematic notation, suitable boxes being well known to persons knowledgeable in the casting art. Suffice it to say that the finned construction can readily be formed with all of the details illustrated, and the outer casting mold can readily be removed.

The removable core may be removed by reducing the material. When casting sand is used, it is readily removed by mechanical means, such as shattering it or cutting it. This leaves the liner in contiguous contact with the surrounding cast cylinder head construction. Finish machining on the bosses may be performed, if desired, but often this is unnecesssary. The sleeve may be further finished if that is believed to be necessary. In any event, there results a cast construction with the flow ports and passages already formed, with the cylinder bore clear, and with the liner bore properly located relative to the cooling fins and the remainder of the assembly. The assembly requires little or no finishing, and even that finishing can be minimized by using improved casting equipment.

The term "reducible material" is used to connote a material which forms a unitary body that can be removed otherwise than as an integral whole. The most important example is casting sand, which can be removed as granules by overcoming the binding effect of the binder. Another example is dissolving the material. The term does not include formation in multiple sections which are separately removed.

This invention is not to be limited by the embodiments shown in the drawings and described in the description, which are given by way of example and not of limitation, but only in accordance with the scope of the appended claims.

We claim:

1. A process for making a composite cylinder head assembly comprising:

a. forming a cylinder liner sleeve with a circularly cylindrical bore and a plurality of ports extending between an inner wall and an outer wall thereof;

b. forming a core of reducible material filling said bore, and at least some of said ports, and including at least one body lying against the outer wall and overlaying at least one of said ports, said core being continuous and unitary, and adapted to exclude molten casting metal from the volume it occupies, said core and sleeve comprising an intermediate structure;

c. placing said intermediate structure in a mold, said mold having an inside contour shaped to form a cylinder head surrounding said intermediate structure;

d. filling the spacing between the intermediate structure and mold with molten metal, cooling the metal and removing the mold; and e. reducing the core and removing the material, whereby to form a cylinder head assembly with a clear bore, open ports, and at least one passage communicating with a port and extending axially alongside the outer wall of the sleeve.

* * * * *